US005631659A

United States Patent [19]

Evans et al.

[11] Patent Number: 5,631,659

[45] Date of Patent: May 20, 1997

[54] MICROSTRIP PATCH ANTENNAS WITH RADIATION CONTROL

[75] Inventors: James G. Evans, Colts Neck; Martin V. Schneider; Robert W. Wilson, both of Holmdel, all of N.J.

[73] Assignee: Lucent Technologies Inc., Murray Hill, N.J.

[21] Appl. No.: 406,290

[22] Filed: Mar. 17, 1995

[51] Int. Cl.[6] ..... H01Q 1/38

[52] U.S. Cl. ..... 343/700 MS; 343/846; 343/767

[58] Field of Search ..... 343/700 MS, 846, 343/829, 830, 847, 848, 872, 767, 768, 771, 772; H01Q 1/38

[56] References Cited

U.S. PATENT DOCUMENTS

| | | | |
|---|---|---|---|
| 3,971,032 | 7/1976 | Munson et al. | 343/700 MS |
| 4,367,475 | 1/1983 | Schiavone | 343/767 |
| 4,755,820 | 7/1988 | Backhouse et al. | 343/700 MS |
| 5,406,292 | 4/1995 | Schnetzer et al. | 343/872 |

FOREIGN PATENT DOCUMENTS

| | | |
|---|---|---|
| 0117017 | 4/1984 | European Pat. Off. . |
| 0217426 | 4/1986 | European Pat. Off. . |
| 0332139 | 7/1989 | European Pat. Off. . |
| 2067842 | 12/1990 | United Kingdom . |
| 2266192 | 8/1993 | United Kingdom . |

*Primary Examiner*—Hoanganh T. Le

[57] ABSTRACT

In a resonator in which a ground plane and a patch sandwich a dielectric, a slot in the patch concentrates emanation of radiation from the slot. Shorting conductors form the ends of the resonator. A dielectric cover over the slot matches the dielectric constant of the substrate to that of free space. Quarter-wave chokes at the ends of the resonator suppress currents in the ground plane.

18 Claims, 2 Drawing Sheets

MICROSTRIP PATCH ANTENNAS WITH RADIATION CONTROL

RELATED APPLICATIONS

This application is related to our co-pending applications Ser. No. 08/351,904 filed Dec. 8, 1994, Ser. No. 08/351,905 filed Dec. 8, 1994 filed Dec. 8, 1994, Ser. No. 08/351,912 filed Dec. 8, 1995, and Ser. No. 08/406,289 filed Mar. 17, 1996, assigned to the same assignee as this application.

FIELD OF THE INVENTION

This invention relates to microstrip antennas, and particularly to methods and means for reducing the size of such antennas and increasing their efficiency.

BACKGROUND OF THE INVENTION

Microstrip patch antennas are composed of a resonant arrangement having a patch and a ground plane printed on or otherwise bonded to opposite faces of a dielectric substrate having a dielectric constant $\epsilon_{r1}$. The patch and the ground plane with the dielectric substrate resonate at a wavelength $\lambda_o$ in free space and a wavelength $\lambda$ in the dielectric substrate. Exclusive of fringe effects, $\lambda=\lambda_o/\sqrt{\lambda_{r1}}$. The patch generally has a length $\lambda/2=\lambda_o/2\sqrt{\lambda_{r1}}$ and the ground plane is as large as available space allows. The antenna generally propagates electromagnetic energy transverse to the plane of the patch. This results on substantial spurious radiation and requires substantial space.

An object of the invention is to improve such antennas.

SUMMARY OF THE INVENTION

According to an aspect of the invention, this object is attained in a resonator in which a ground plane and a resonant patch sandwich a dielectric substrate by forming a slot in the patch from which radiation emanates.

According to another aspect a dielectric cover over the slot matches the dielectric constant of the substrate to free space.

According to another aspect, quarter wave chokes are formed with the ground plane at the ends of the resonator and limit currents in the ground plane, and the ground plane has dimensions limited to the dimensions of the resonator and chokes.

These and other features of the invention are pointed out in the claims. Other objects and advantages of the invention will become evident from the following detailed description of the invention when read in light of the following drawings.

DETAILED DESCRIPTION OF THE PREFERRED EMBODIMENTS

Figure 1:
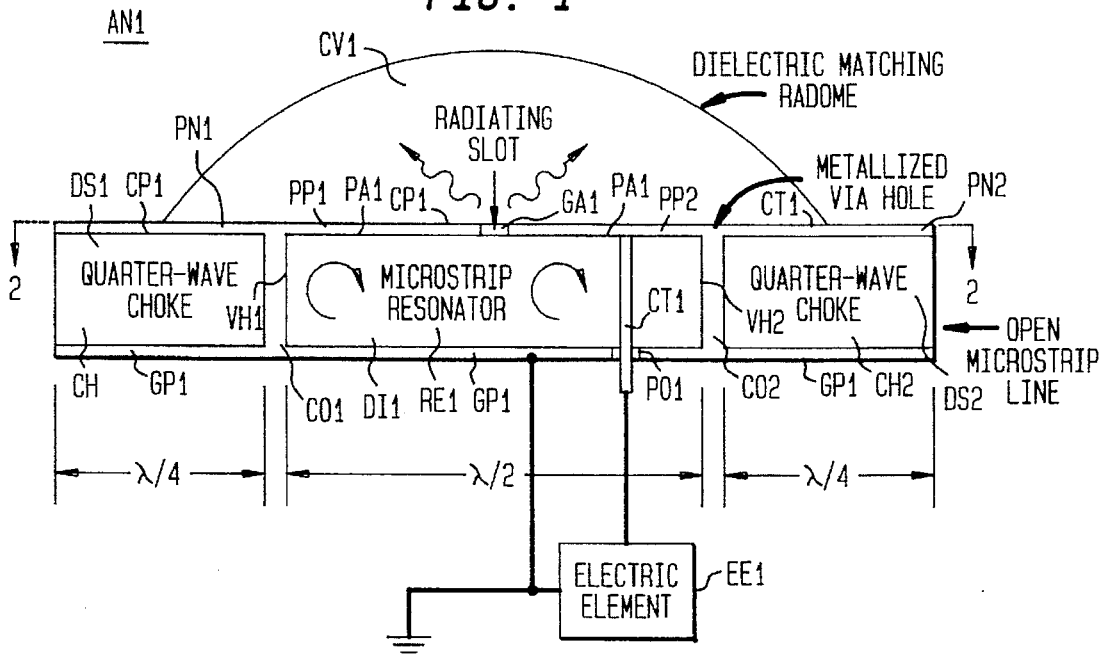
FIG. 1 is a sectional view of a system with an antenna embodying the invention.
Figure 2:
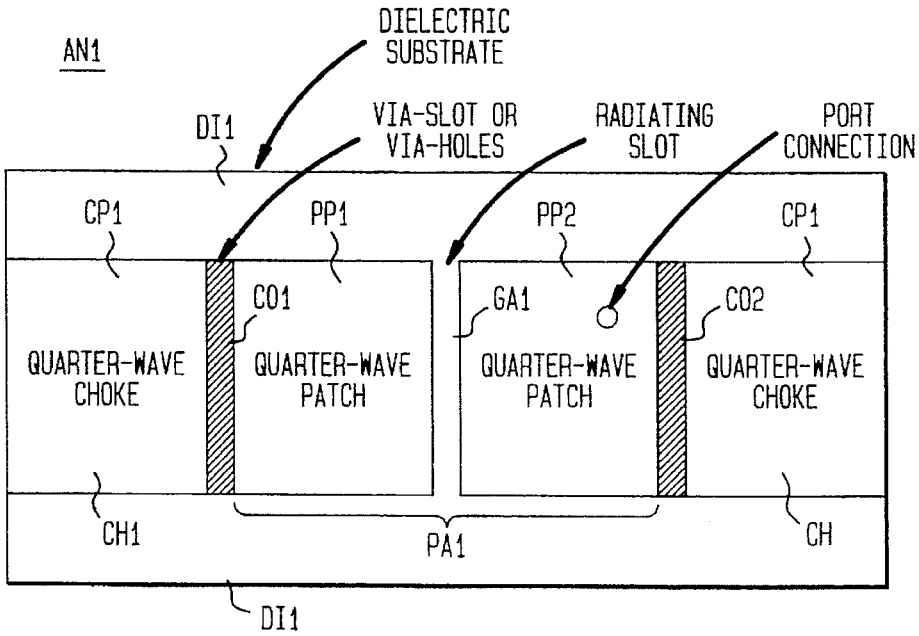
FIG. 2 is a section 2—2 of FIG. 1.
Figure 3:
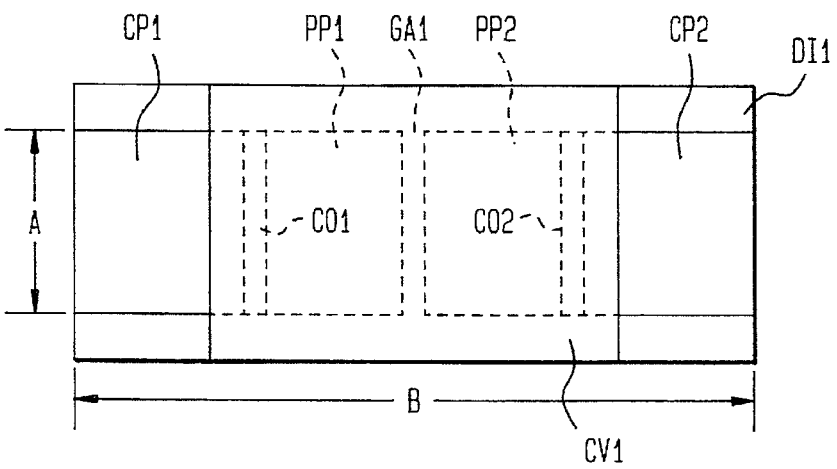
FIG. 3 is a plan view of FIG. 1.

In FIGS. 1, 2, and 3, wherein like reference characters represent like parts, a system includes an antenna AN1 embodying aspects of the invention. Briefly, a resonant patch PA1 and a ground plane GP1 bonded to opposite faces of a dielectric substrate DI1, and two conductors CO1 and CO2, form a resonator RE1 having a length $\lambda/2=\lambda_o/2\sqrt{\epsilon_{r1}}$. The Conductors CO1 and CO2 are located at opposite ends of the resonator RE1 and short the ends of the patch PA1 to the ground plane. A gap GA1 forms a slot and divides the patch PA1 into two patch portions PP1 and PP2. The GA1 concentrates radiation or radiation detection to the slot formed by the gap. The gap GA1 and the conductors CO1 and CO2 transform the resonator into a slotted waveguide.

A cylindrical dielectric "radome" cover CV1 matches the dielectric constant of the substrate DI1 to free space. Two quarter-wave chokes CH1 and CH2 extending from conductors CO1 and CO2 located at opposite ends of the resonator RE1 suppress fringe radiation at ground plane.

In more detail, the resonator RE1 includes the ground plane GP1 printed on or otherwise bonded to one face of the dielectric substrate DI1. The opposite face of the latter supports a conductive pattern CP1 also printed on or otherwise bonded to the dielectric substrate DI1. A pair of metallized via holes VH1 and VH2 form the wall-like conductors CO1 and CO2 that connect the conductive pattern CP1 across its entire width, to the ground plane GP1. The portion of the conductive pattern CP1 between the conductors CO1 and CO2 forms the resonant patch PA1. The latter, together with the conductors CO1 and CO2 and the immediately underlying sections of the substrate DI1 and ground plane GP1, define the extent of the resonator RE1. The gap GA1 divides the patch PA1 into the two sub-patches or patch portions PP1 and PP2 and forms the radiating slot between the portions. The resonator RE1 constitutes and behaves as a slotted waveguide.

A conductor CT1 connects an electrical element EE1 to the patch PA1 through a patch port PO1 and an opening in the dielectric DI1. The other end of the element EE1 is grounded to the ground plane GP1. The element EE1 may be a source of electromagnetic energy or a load, depending on whether the antenna AN1 is used to send or receive.

The dielectric substrate DI1 has a dielectric constant $\epsilon_{r1}$. The resonator RE1 resonates at a wavelength $\lambda_o$ in free space and a wavelength $\lambda$ in the dielectric substrate. Exclusive of fringe effects, $\lambda=\lambda_o/\sqrt{\epsilon_{r1}}$. The patch has a length $\lambda/2=\lambda_o/2\sqrt{\epsilon_{r1}}$ in the longitudinal direction (left-right in FIG. 1). The dimension, in the longitudinal direction of the pattern PT1, of the gap GA1 which divides the patch PA1 into portions PP1 and PP2 constitutes a small portion such as ⅕ of the patch length and is substantially equal to $\lambda/10$. Hence the portions PP1 and PP2 have lengths substantially equal to $\lambda/4=\lambda_o/4\sqrt{\epsilon_{r1}}$.

Pattern parts PN1 and PN2 of the pattern CP1, outboard sections DS1 and DS2 of the dielectric substrate DI1, and outer parts of the ground plane GP1, all extending outward of the conductors CO1 and CO2 form the respective quarter-wave chokes CH1 and CH2 in the presence of the conductors CO1 and CO2. The chokes CH1 and CH1 suppress currents in the ground plane GP1 and hence back-lobe radiation in the resonator RE1. The pattern parts PN1 and PN2 of the pattern CP1, and hence the chokes CH1 and CH2, each have a length substantially equal to $\lambda/4=\lambda_o/4\sqrt{\epsilon_{r1}}$. The chokes CH1 and CH2 respond to currents in the ground plane GP1 and produce reflections twice one-quarter, hence one-half, wavelength out of phase with these ground plane currents and thus cancel the currents.

The dielectric matching "radome" cover CV1 of cylindrical shape is bonded to the conductive pattern CP1 and the dielectric substrate and extends axially parallel to the gap GA1. The dielectric constant of the cover CV1 lies between the dielectric constant $\epsilon_{r1}$ of the substrate DI1 and the dielectric constant 1.0 of free space. Preferably the cover has a matching dielectric constant $\sqrt{\epsilon_{r1}}$ for directly matching the dielectric constant of the substrate DI1 to free space. According to a preferred embodiment of the invention, the cover CV1 is a semi-cylinder with an axis through the gap GP1. In another embodiment the cover is rectangular.

According to an embodiment of the invention, the ground plane GP1 has dimensions corresponding to the "footprint", i.e. dimensions of the conductive pattern CP1. That is, it only extends directly underneath the pattern CP1 along dimensions A and B in FIG. 3. In this configuration, the ground plane exhibits efficiencies of larger ground planes which theoretically should be infinite.

In operation during the transmit mode, the element EE1 serves as a source of electromagnetic energy and causes resonance in the antenna. The resonator RE1 operates in the manner of a slotted waveguide. Energy is transmitted radially out of the antenna at the slot formed by the gap GA1. If the element EE1 is a receiving load, energy is gathered radially at the slot formed by the gap GP1. The cylindrical dielectric cover CV1 matches the dielectric constant of the substrate DI1 to that of free space and hence increases the efficiency of operation. The quarter-wave chokes CH1 and CH2 effect reflections in the ground plane GP1 and produce waveforms half-wave out of phase with the currents in the ground plane. This opposite-phase relationship suppresses currents in the ground plane and reduces back lobes.

Theoretically, a ground plane should be infinite in planar dimensions for ideal efficiency. In the present embodiment, the ground plane has a length equal to λ, but has the effects of substantially larger ground planes.

Figure 4:
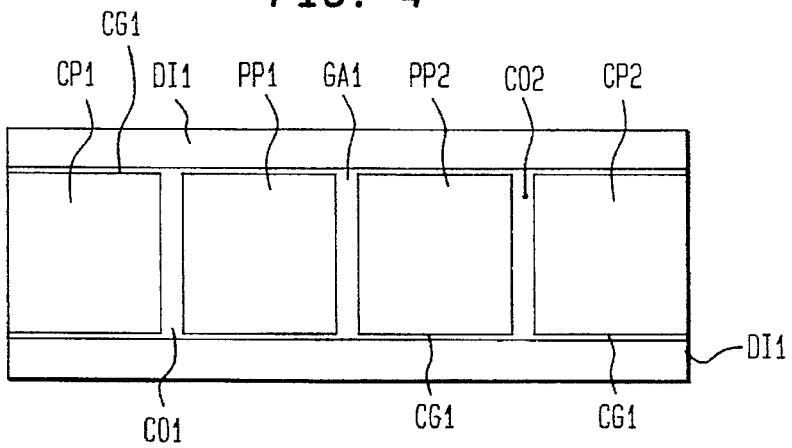
FIG. 4 is a cross-sectional view of another embodiment of the system in FIGS. 1 to 3.
Figure 5:
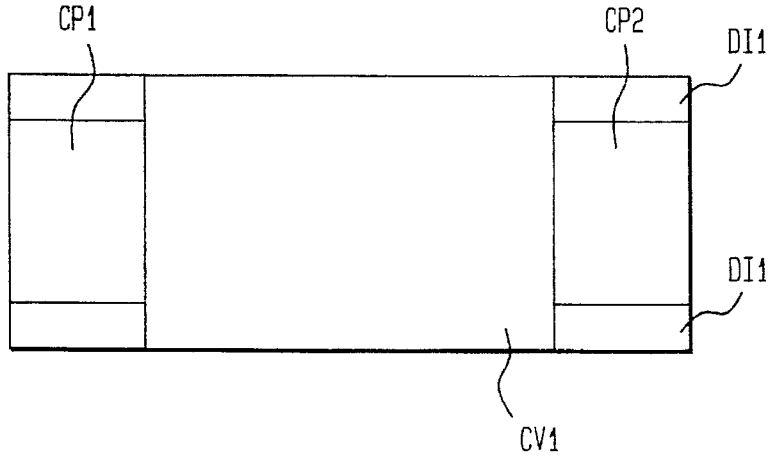
FIG. 5 is a plan view of the embodiment in FIG. 4.

Another embodiment of the invention appears in the plan cross-section of FIG. 4 and the plan view of FIG. 5. Here, like reference characters identify parts corresponding to those in FIGS. 1 to 3. FIGS. 4 and 5 differ from the embodiment in FIGS. 1 to 3 in that conductive coatings CG1 and CG2 cover the previously exposed sides of dielectric substrates DI1 and DS1 and DS2. This further reduces extraneous radiation. The antenna otherwise operates like that in FIGS. 1 to 3. The conductive coatings CG1 and CG2 separate the outboard sections DS1 and DS2 of the substrate DI1 form the main substrate. However they may still be regarded as part of the substrate DI1. To the extent that the structure of FIGS. 4 and 5 correspond to that of FIGS. 1 to 3, the section of FIG. 4 is taken along 2—2 of FIG. 1.

While embodiments of the invention have been described in detail, it will be evident to those skilled in the art that the invention may be embodied otherwise without departing from its spirit and scope.

What is claimed is:

1. A microstrip antenna, comprising:

a resonator having a dielectric substrate, a conductive ground plane, and a conductive patch, said ground plane and said patch sandwiching said dielectric substrate; and a radiating slot dividing said patch into two separate portions;

said patch having an overall length along one direction, said slot being dimensioned such that each of said portions has a fixed length along the one direction equal substantially to one half the overall length;

said resonator including a pair of ends, one at each portion, and a pair of waveguide forming conductors each shorting an end to the ground plane such that the resonator forms a slotted waveguide; and a pair of chokes each extending from a respective one of said ends in a direction away from the slot.

2. A microstrip antenna as in claim 1, wherein said chokes each includes a conductive extension on one of said portions, a conductive continuation of said ground plane, and a part of the substrate being between said ground plane and said extension.

3. A microstrip antenna as in claim 2, wherein the overall length of said patch is λ/2 to resonate at a given wavelength λ depending on a dielectric constant of said substrate, and each of said portions has the fixed length substantially equal to a quarter of said wavelength.

4. A microstrip antenna as in claim 2, wherein said resonator includes a dielectric superstrate covering said patch.

5. A microstrip antenna as in claim 2, wherein said resonator includes a dielectric superstrate covering said patch, said dielectric superstrate being in the shape of a semi-cylinder.

6. A microstrip antenna as in claim 5, wherein said dielectric substrate has a first dielectric constant and said superstrate covering said patch has a second dielectric constant between the first dielectric constant and the dielectric constant of free space.

7. A microstrip antenna as in claim 6, wherein said second dielectric constant matches the first dielectric constant to the dielectric constant of free space.

8. A microstrip antenna as in claim 7, wherein the overall length of said patch is λ/2 to resonate at a given wavelength λ depending on a dielectric constant of said substrate, and each of said portions has the fixed length substantially equal to a quarter of said wavelength.

9. A microstrip antenna as in claim 1, wherein the overall length of said patch is λ/2 to resonate at a given wavelength λ depending on a dielectric constant of said substrate, and each of said portions has the fixed length substantially equal to a quarter of said wavelength.

10. A microstrip antenna as in claim 9, wherein said waveguide forming conductors shorting an end to said ground plane short the end to said ground plane through said dielectric substrate.

11. A microstrip antenna as in claim 9, wherein said patch and said chokes extend along a given length and said ground plane extends along a length equal to the given length.

12. A microstrip antenna as in claim 1, wherein said resonator includes a pair of opposing sides along said substrate and a conductive coating on each side connecting said patch to said ground plane to close said waveguide formed by said conductors.

13. A microstrip antenna as in claim 1, wherein said patch and said chokes extend along a given length and said ground plane extends along a length equal to the given length.

14. A microstrip antenna as in claim 1, wherein said resonator includes a dielectric superstrate covering said patch.

15. A microstrip antenna as in claim 1, wherein said resonator includes a dielectric superstrate covering said patch, said dielectric superstrate being in the shape of a semi-cylinder.

16. A microstrip antenna as in claim 15, wherein said dielectric substrate has a first dielectric constant and said superstrate covering said patch has a second dielectric constant between the first dielectric constant and the dielectric constant of free space.

17. A microstrip antenna as in claim 16, wherein said second dielectric constant matches the first dielectric constant to the dielectric constant of free space.

18. A microstrip antenna as in claim 1, wherein said ground plane is dimensioned substantially the same as the patch.

* * * * *